US008083336B2

(12) United States Patent
Gold et al.

(10) Patent No.: US 8,083,336 B2
(45) Date of Patent: Dec. 27, 2011

(54) INK STICK JAM DETECTION AND RECOVERY SYSTEM AND METHOD

(75) Inventors: Christopher Ryan Gold, Tigard, OR (US); Michael Kenneth Oehl, Beaverton, OR (US)

(73) Assignee: Xerox Corporation, Norwalk, CT (US)

( * ) Notice: Subject to any disclaimer, the term of this patent is extended or adjusted under 35 U.S.C. 154(b) by 432 days.

(21) Appl. No.: 12/355,929

(22) Filed: Jan. 19, 2009

(65) Prior Publication Data

US 2010/0182357 A1 Jul. 22, 2010

(51) Int. Cl.
*B41J 2/175* (2006.01)
*B41J 29/38* (2006.01)

(52) U.S. Cl. ..... 347/88; 347/99; 347/17

(58) Field of Classification Search ..... 347/88, 347/99, 17

See application file for complete search history.

(56) References Cited

U.S. PATENT DOCUMENTS

| | | | | |
|---|---|---|---|---|
| 4,574,939 | A * | 3/1986 | Dubuit | 198/396 |
| 4,593,292 | A * | 6/1986 | Lewis | 347/88 |
| 5,442,387 | A * | 8/1995 | Loofbourow et al. | 347/88 |
| 5,861,903 | A * | 1/1999 | Crawford et al. | 347/88 |
| 6,981,754 | B2 | 1/2006 | Godil et al. | |
| 7,011,399 | B2 * | 3/2006 | Godil et al. | 347/88 |
| 7,147,313 | B2 | 12/2006 | Godil et al. | |
| 7,458,669 | B2 | 12/2008 | Jones et al. | |
| 2008/0218572 | A1 * | 9/2008 | Fairchild et al. | 347/99 |
| 2009/0102905 | A1 * | 4/2009 | Fairchild et al. | 347/88 |
| 2010/0026741 | A1 * | 2/2010 | Gold et al. | 347/7 |

* cited by examiner

*Primary Examiner* — Julian Huffman
*Assistant Examiner* — Sharon A Polk
(74) *Attorney, Agent, or Firm* — Maginot, Moore & Beck, LLP

(57) ABSTRACT

An ink jam detection and recovery system for use in a phase change ink imaging device includes an ink stick conveyance configured move ink sticks in a forward direction toward a melt plate at a melt end of an ink stick feed path and a reverse direction away from the melt plate. A sensor system is configured to generate a first signal indicative of whether an ink stick is present at the melt plate. A controller is configured to receive the signal and to actuate the ink stick conveyance to move in at least one of the forward direction and the reverse direction in response to the first signal indicating that no ink stick is present at the melt plate.

11 Claims, 7 Drawing Sheets

INK STICK JAM DETECTION AND RECOVERY SYSTEM AND METHOD

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to an ink reservoir which maintains the ink in melted form for delivery to a print head for jetting onto a recording medium.

One difficulty faced during operation of solid ink printers is the ink reservoirs exhausting the available supply of melted ink and running dry. If a reservoir were to run dry, the printing system may suffer a catastrophic failure and be unable to print. When the ink level in an ink reservoir reaches or falls below a "low" ink level, a melt duty cycle is initiated in order to refill the reservoir with melted ink. However, if a melt duty cycle is initiated and there are no ink sticks engaging the melt plate, the continued generation of heat by the melt plates may damage the heater and adjacent components because an ink stick helps absorb heat generated by the melt plate and aids in temperature regulation of the melt plate.

Ink sticks may not be available to engage the melt plate during a melt cycle. Unavailability of ink sticks may arise from ink out or ink jam conditions. An ink out condition occurs because a feed channel has exhausted its available supply of solid ink sticks. An ink stick jam condition arises when one or more ink sticks have gotten trapped or jammed in an ink feed channel prior to reaching the melt plate at the end of the channel. Ink stick jams may occur due to ink sticks becoming skewed in the respective feed channel as they are being fed toward the melt plate and/or due to ink stick particles and debris accumulating in a feed channel and blocking or interfering with ink stick travel in the feed channel.

The absence of an ink stick at a melt plate in a feed channel may be detected by monitoring the temperature of the melt plate using the melt plate temperature sensor, e.g., thermistors, and comparing the sensed temperature to a predetermined temperature indicative of no ink stick being present at a melt plate. In response, the controller interrupts the application of power to the melt plate, printing is disabled, and a user intervention fault is declared. For example, a user intervention fault may include alerting the printing operator to the ink out or ink jam condition. The operator may also be prompted to take corrective action such as inserting ink sticks into the feed channel corresponding to the overheated melt plate or attempting manual removal of jammed ink sticks from the feed channel.

SUMMARY

An ink jam detection and recovery system for use in a phase change ink imaging device has been developed that enables ink out and ink jam conditions to be distinguished and enables the recovery from at least some ink stick jam conditions. The system includes an ink stick conveyance configured move ink sticks in a forward direction toward a melt plate at a melt end of an ink stick feed path and a reverse direction away from the melt plate. A sensor system is configured to generate a first signal indicative of whether an ink stick is present at the melt plate. A controller is configured to receive the signal and to actuate the ink stick conveyance to move in at least one of the forward direction and the reverse direction in response to the first signal indicating that no ink stick is present at the melt plate.

In another embodiment, a method of ink stick jam detection and recovery for use in a phase change ink imaging device is provided. The method includes generating a first signal indicative of whether an ink stick is present at a melt plate at a melt end of an ink feed path; and actuating an ink stick conveyance to move in at least one of a first direction toward the melt end for a first duration and a second direction away from the melt end for a second duration in response to the characteristic indicating a possible ink stick jam condition.

In yet another embodiment, a method of ink stick jam detection and recovery for use in a phase change ink imaging device comprises measuring a temperature of a melt plate during a melt duty cycle, the melt plate being positioned at a melt end of an ink stick feed path of an ink loader of a phase change ink imaging device; comparing the temperature to a predetermined temperature; detecting whether ink sticks are on the ink stick feed path in response to the comparison indicating that the melt plate temperature exceeds the predetermined temperature; and actuating an ink stick conveyance to move in at least one of a first direction toward the melt end for a first duration and a second direction away from the melt end for a second duration in response to the detection indicating that an ink stick is present on the ink stick feed path.

DETAILED DESCRIPTION OF THE PREFERRED EMBODIMENT

Figure 1:
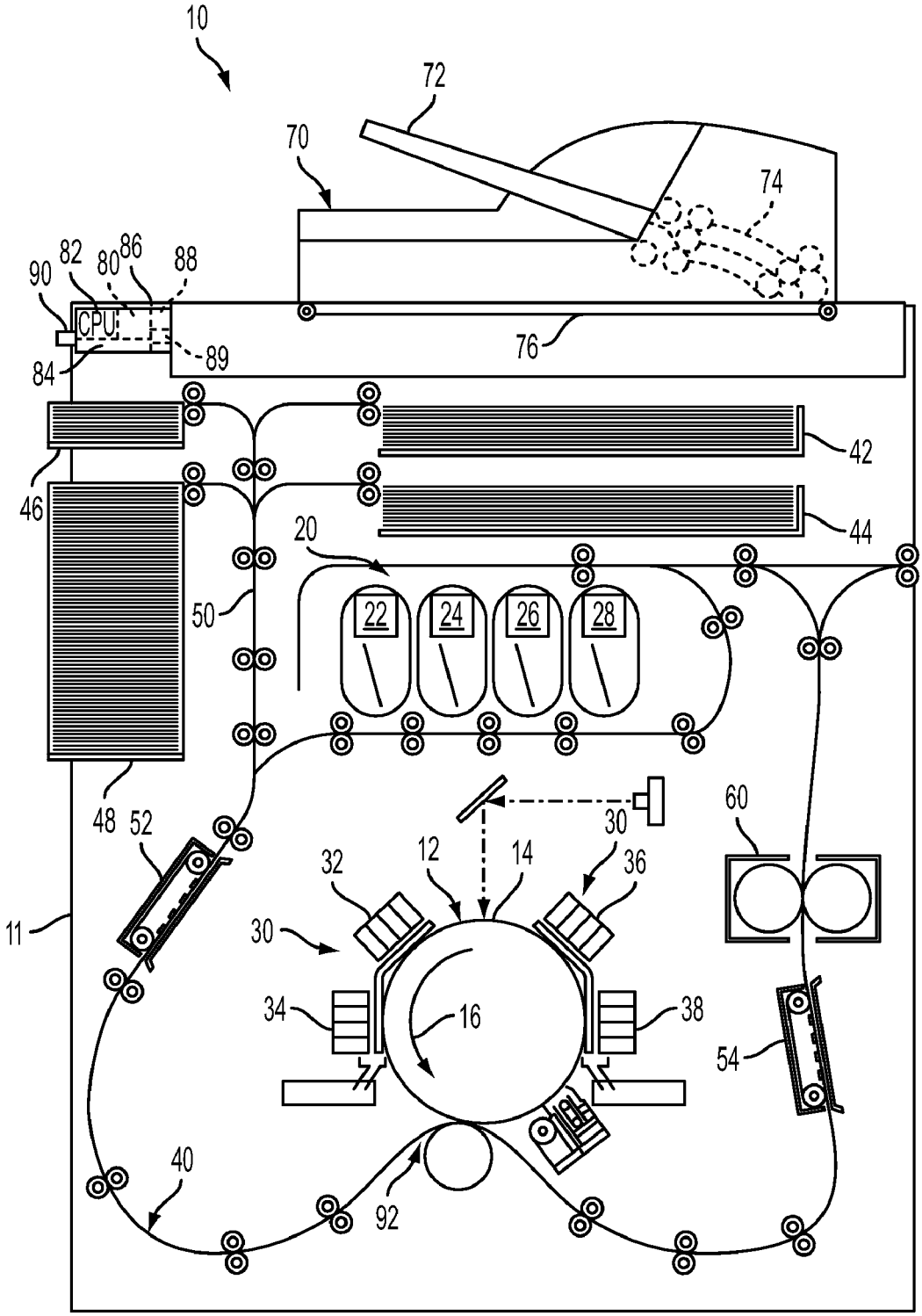
FIG. 1 is a block diagram of a phase change ink imaging device.

For a general understanding of the system disclosed herein as well as the details for the system and method, reference is made to the drawings. In the drawings, like reference numerals have been used throughout to designate like elements. As used herein, the word "printer," "imaging device," "image producing machine," etc. encompasses any apparatus that performs a print outputting function for any purpose, such as a digital copier, bookmaking machine, facsimile machine, a multi-function machine, etc.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink system 20 that has at least one source 22 of one color phase change ink in solid form. Since the phase change ink image producing machine or printer 10 is a multicolor image producing machine, the ink system 20 includes for example four (4) sources 22, 24, 26, 28, representing four (4) different colors CYMK (cyan, yellow, magenta, black) of phase change inks. The phase change ink system 20 also includes a phase change ink melting and control assembly 100 (FIG. 2), for melting or phase changing the solid form of the phase change ink into a liquid form. Thereafter, the phase change ink melting and control assembly 100 then controls and supplies the molten liquid form of the ink towards a printhead system 30 including at least one printhead assembly 32. Since the phase change ink image producing machine or printer 10 is a high-speed, or high throughput, multicolor image producing machine, the printhead system includes for example four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

Figure 2:
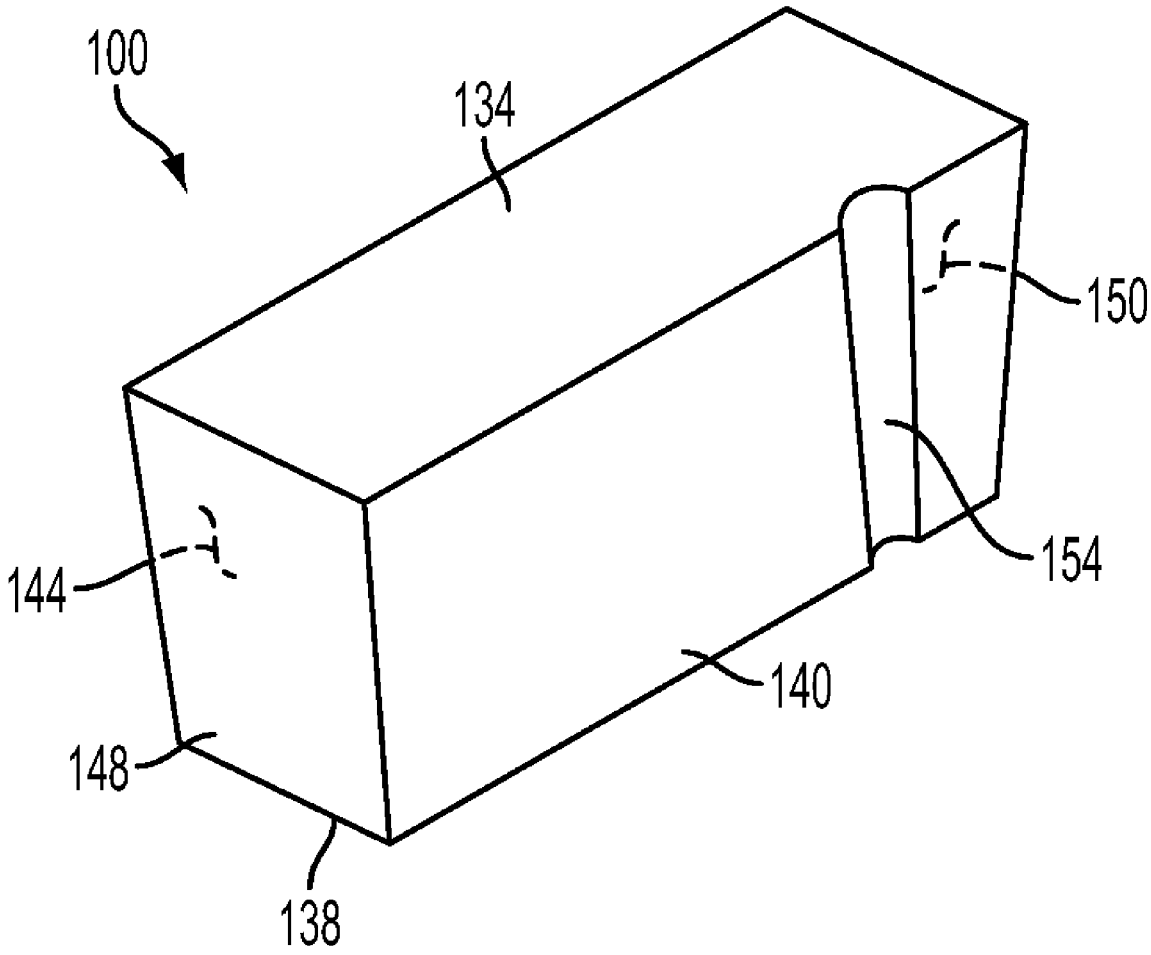
FIG. 2 is a perspective view of one embodiment of a solid ink stick for use with the imaging device of FIG. 1.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by system 50 in timed registration with image formation on the surface 14. Finally, the image is transferred within the transfer nip 92, from the surface 14 onto the receiving substrate for subsequent fusing at fusing device 60. imaging surface 14 thus forming desired images per such image data, and An ink stick for use with the imaging device 10 may take many forms. One exemplary solid ink stick 100 for use in the ink delivery system 20 is illustrated in FIG. 2. The ink stick has a bottom surface 134 and a top surface 138. The particular bottom surface 134 and top surface 138 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Ink sticks may include a number of features that aid in correct loading, guidance, sensing and support of the ink stick when used. These loading features may comprise protrusions and/or indentations that are located in different positions on an ink stick for interacting with key elements, guides, supports, sensors, etc. located in complementary positions in the ink delivery system. Loading features may be categorized as insertion features or feeding features. Insertion features such as exclusionary keying elements and orientation elements are configured to facilitate correct insertion of ink sticks into the loading station and, as such, are substantially aligned with the insertion direction L of the loading station. As an example, the ink stick of FIG. 2 includes an insertion keying feature 154. The insertion keying feature is configured to interact with the keyed openings 60 of the loading station 204 (FIG. 3) to admit or block insertion of the ink sticks through the insertion opening 60 of the solid ink delivery system. In the ink stick embodiment of FIG. 2, the key element 154 is a vertical recess or notch formed in side surface 140 of the ink stick body substantially parallel to the insertion direction of the loading station. The corresponding complementary key (not shown) on the perimeter of the keyed opening 60 is a complementary protrusion into the opening 60.

Each color for a printer may have a unique arrangement of one or more key elements in the outer perimeter of the ink stick to form a unique cross-sectional shape for that particular color ink stick. The combination of the keyed openings in the key plate and the keyed shapes of the ink sticks insure that only ink sticks of the proper color are inserted into each feed channel. A set of ink sticks is formed of an ink stick of each color, with a unique key feature arrangement for ink sticks of each color. Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers. Ink stick descriptions of or similar to "substantially the same shape" are intended to encompass keying and form variations that physically and/or visibly differentiate the sticks of a set or sets from one another but where, absent those one or more features, would appear to be substantially the same shape. Likewise for size even though some mass variation beyond color formulation may be involved.

Although not depicted, the ink stick may include feeding features, such as alignment and guide elements, to aid in aligning and guiding ink sticks as they are moved along the feed channels to reduce the possibility of ink stick jams in the feed channel and to promote optimum engagement of the ink sticks with an ink melter in the ink melt assembly. Feeding features, therefore, may be substantially aligned with the feed direction F of the ink delivery system in order to interact with ink stick guides and/or supports in the ink delivery system. An ink stick may have any suitable number and/or placement of loading (i.e. insertion and/or feeding) features.

Figure 3:
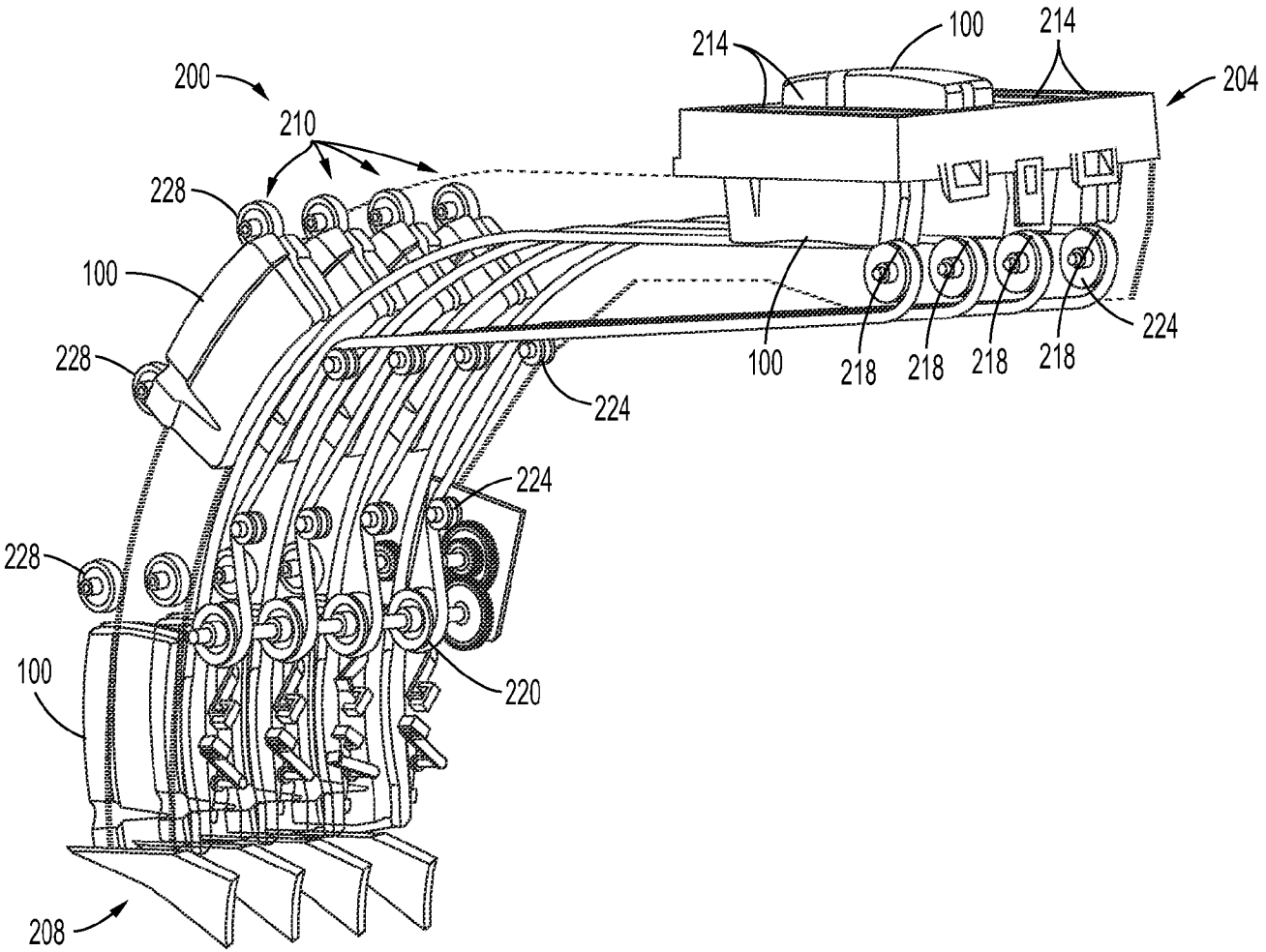
FIG. 3 a perspective view of the solid ink delivery system of the imaging device of FIG. 1.

Referring now to FIG. 3, an embodiment of a solid ink delivery system 200 is depicted. The solid ink delivery system 200 advances ink sticks from loading station 204 to a melting station 208. The melting station 208 is configured to melt the solid ink sticks and supply the liquid ink to the printhead assembly 30. The ink delivery system 200 includes a plurality of channels, or chutes, 210. A separate channel 210 is utilized for each of the four colors: namely cyan, magenta, black and yellow. However, the ink delivery system 200 may be configured to utilize more or fewer colors than the four colors mentioned, and, therefore, may include any suitable number of color channels. Color order mentioned here and elsewhere is not necessarily representative of the product and for the purpose of this invention, is not significant.

The loading station includes keyed openings 214. Each keyed opening 214 provides access to an insertion end of one of several individual feed channels 210 of the ink delivery system. The keyed openings 214 are configured to interact with key elements formed in ink sticks to admit or block insertion of the ink through the keyed insertion opening of the ink delivery system.

To better utilize the space within the imaging device 10, the feed channels 210 may have a shape that is not linear such that a greater number of ink sticks may be placed therein than may be possible with a linear feed channel. Therefore, feed channels 210 may define any suitable path for delivering ink sticks from the loading station 204 to the melt station 208. For example, the feed channels 210 may have linear and curved sections as needed to deliver respective ink sticks from the loading station to the melting station. An arcuate portion of the feed path may be short or may be a substantial portion of the path length. The full length of the chute may be arcuate and may consist of different or variable radii. A linear portion of the feed path may likewise be short or a substantial portion of the path length.

The solid ink delivery system 200 further includes ink stick conveyances or transporters 218 for moving one or more ink sticks 100 along a feed path in the respective feed channel 210. A separate stick transporter 218 is provided for each respective feed channel. The feed channel 210 for each ink color retains and guides ink so that the ink progresses along a desired feed path. The stick transporter 218 may be any appropriate type of conveyance and have any suitable size and shape. The stick transporter may be used to transport the ink over all or a portion of the feed path and may provide support or guidance to the ink and may be the primary ink guide over all or a portion of the feed path. Each stick transporter includes a driver that is configured to impart the necessary motion to the stick transporter to transport one or more ink sticks between the insertion end and the melt end of the feed channel. Drivers may be any suitable device such as a motor assembly (not shown), and may be configured to impart bi-directional movement to the transporters for moving ink sticks forward and backward along the feed path. In one embodiment, each stick transporter 218 comprises a belt that extends along a substantial portion of the path of the feed channel 210. The belt 218, as shown in FIG. 3, may have a circular cross-section and be held taut by a pair of spaced apart pulleys in the form of a drive pulley 220 and one or more idle pulleys 224. The drive pulley 220 may be rotated by a suitable driver such as a motor assembly (not shown). Note that the conveyance or transport will be described chiefly as a belt style conveyer but that other types of reversible transport are equally applicable, walking beams and driven rollers or wheels, as example.

A loader with linear and non linear portions must provide guidance to the ink over the full feed path, including transitions and sections where gravity does not force intimate contact. Thus, ink guidance may include a transport and other elements of the channel, individually or in concert, as appropriate for the feed path. For example, the feed channels may include nudging members 228 in the form of, for example, pinch rollers that may be spring loaded and biased against the belt 218 to assure sufficient friction between the belt and the sticks 100 such that the sticks do not fall by gravity and slip away from the belt.

Figure 4:
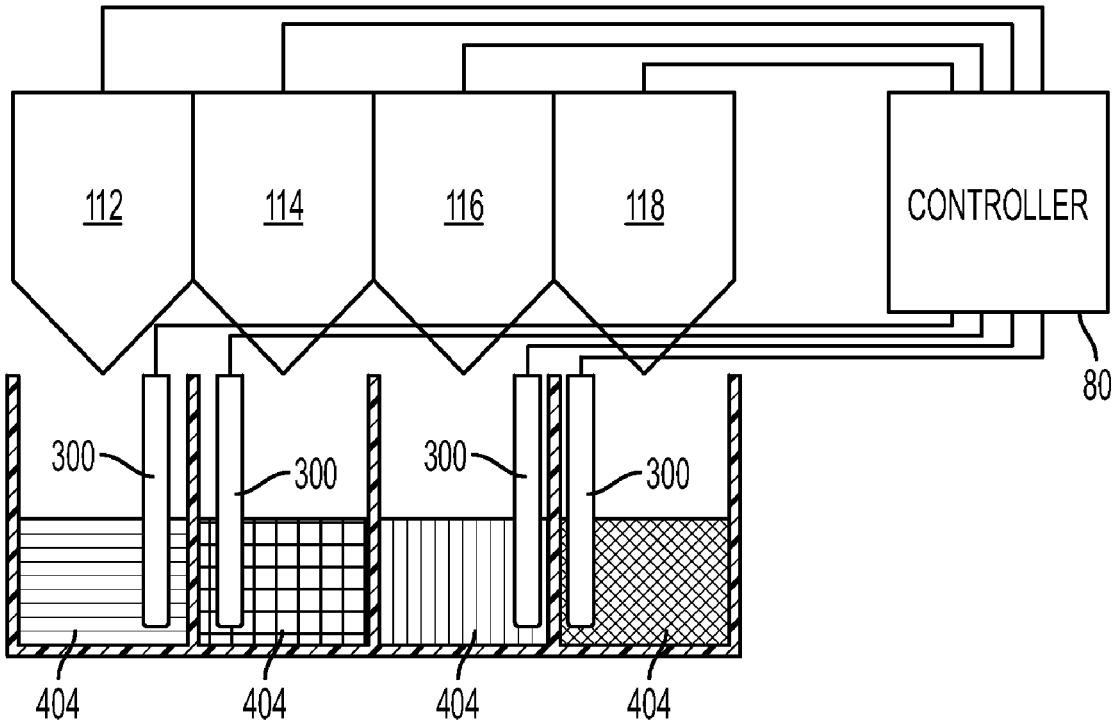
FIG. 4 is a perspective view of the ink melt plates and ink reservoirs of the imaging device of FIG. 1.

The feed channels of the ink delivery system are configured to deliver ink sticks to a melt station at the melt end of the feed channels. Referring to FIG. 4, the melt station includes an ink melter, such as a melt plate 112, 114, 116, 118, for melting the solid phase change ink into the liquid phase. In one embodiment, the melt plates are configured to heat ink sticks engaged therewith to about 100° C. to 140° C. to melt the solid ink to liquid form although any suitable temperature may be used. The melted ink is then communicated to a melted ink reservoir 404 which is configured to hold a quantity of melted ink and to maintain the melted ink in liquid form for delivery to the printhead assembly 30 as needed.

In order to prevent the ink storage and supply assembly 400 of the imaging device from exhausting the available supply of ink, the reservoirs 404 of the ink storage and supply assembly 400 may be provided with ink level sensors 300. FIG. 4 shows an exemplary reservoir ink level sensing system. As depicted in FIG. 4, the ink level sensing system includes an ink level sensor 300 positioned in each reservoir 404. Each level sensor is in communication with controller 80. The level sensors 300 are configured to generate one or more signals indicative of the ink level in the corresponding ink reservoir. The controller 80 is configured to receive the signals indicative of the ink levels in each of the reservoirs.

During operation, the controller 80 is configured to maintain a substantially consistent amount of melted ink in the reservoirs available for delivery to the printheads. Accordingly, during operations, the controller 80 is configured to monitor the ink level sensors 300 to determine when the ink level of a reservoir reaches one or more predetermined threshold levels. For example, when a level sensor 300 indicates that the ink level in a reservoir has fallen below a "start fill" level, the controller is configured to signal the corresponding ink melter 112, 114, 116, 118 to begin melting and supplying ink to the ink reservoir. The controller 80 is configured to monitor the ink level sensor in the reservoir as the melted ink is being supplied to the reservoir to determine when a "stop fill" level is reached at which point the controller is configured to signal the appropriate melter to stop supplying ink to the reservoir. Detecting an ink supply deficiency, melting the solid ink in response to the deficiency, and refilling the reservoir to a supply level with the melted ink may be referred to as an "ink melt duty cycle." In addition to the start fill and stop fill levels, the controller is configured to monitor the ink levels as the reservoir is being filled to determine when a "last dose" level is reached at which point the controller may pause operations until the reservoir has been replenished. The last dose level corresponds to the level of ink at which continued printing operations run the risk of running the reservoir dry.

Referring to FIG. 4, the melt station includes four melt plates, 112, 114, 116, 118 each corresponding to a separate ink feed channel 58. The melt plates 112, 114, 116, 118 can be formed of a thermally conductive material, such as metal, among others. During a melt duty cycle, the melt plates may receive energy from a power supply that is under the control of a control system such as controller. In one embodiment, with particular reference to FIG. 5, power pads 310 on the melt plates connect wires (not shown) from a power supply to the melt plate. The melt plates include heating elements 314 that are configured to convert electrical energy supplied from the power supply(s) to heat energy as is known in the art. In one embodiment, the heating elements comprise resistance traces although any suitable type of heating element or device may be used to generate the requisite thermal energy in the melt plates. Alternatively, a positive temperature coefficient (PTC) film heater may be employed. PTC refers to materials that experience an increase in electrical resistance when their temperature is raised.

Figure 5:
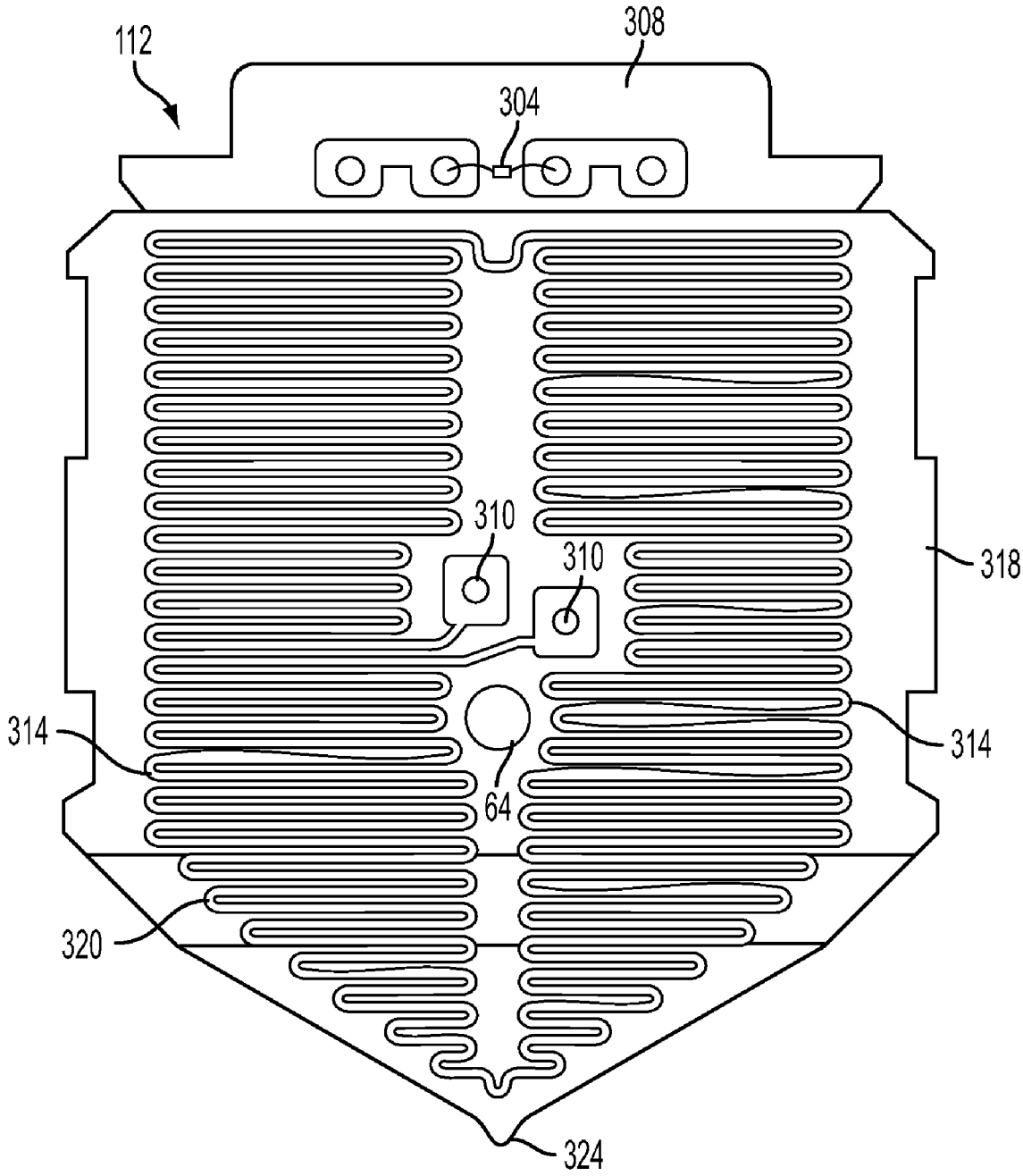
FIG. 5 is an enlarged elevational view of a melt plate of FIG. 4.

As depicted in FIG. 5, the melt plate includes a first portion 318 disposed to engage the ink stick and phase change the solid ink stick to a liquid. A heated liquid ink zone 320 then allows the liquid ink to flow to an ink drip point 324. The liquid phase change ink then drips from the drip point 324 to the associated ink reservoir (not shown in FIG. 5). The melted ink from the melters may be directed gravitationally or by other means to the corresponding reservoir 404. It should be appreciated that the embodiment shown in FIG. 5 comprises the side of the heater element having the heat traces shown. The ink stick will actually contact the element comprising a metallic heat plate on a back side from that shown in FIG. 5. A sensing device 304 is associated with the melt plate 112 for detecting a characteristic of the melt plate indicative of, for example, the temperature of the melt plate or power level supplied to the melt plate. In the embodiment of FIG. 5, the sensing device 304 comprises a thermistor mounted on a depending portion 308 of the melt plate. Any suitable sensing device, however, may be used such as thermometers, electrical sensors, chemical sensors, or the like. The sensing device 304 is in direct communication with the controller 80 and is configured to output a signal to the controller that is indicative of the temperature of the melt plate or the corresponding power level supplied to the melt plate. In embodiments in which the melt plate heating elements are formed of PTC material, as traces or as a film, the heater element(s) itself may serve as the sensing device to provide thermal feedback to the controller. For example, one way this may be accomplished is by briefly removing the heat generating power to the PTC heater and then using a low voltage signal to determine the resistance through the heater element. That resistance changes as a function of temperature and so can be used in a manner similar to a sensor such as a thermistors or thermocouple. The resistance/temperature curve can be calibrated or mapped to overcome any unit to unit variation.

One difficulty faced during operation of the printer 10 is the ink reservoirs exhausting the available supply of melted ink and running dry. If a reservoir were to run dry, the printing system may suffer a catastrophic failure and be unable to print. As mentioned above, when the ink level in an ink reservoir reaches or falls below a start fill level, a melt duty cycle is initiated in order to refill the reservoir with melted ink. However, if a melt duty cycle is initiated and there are no ink sticks engaging the melt plate, the continued application of the power to the elements of the melt plates to melt an ink stick could cause high temperature damage to the heater itself and to adjacent components. For example, an ink stick engaged with a melt plate absorbs heat generated by the melt plate and thus tends to have a cooling effect on the melt plate. When a melt duty cycle is initiated without an ink stick engaged with the melt plate, the temperature of the melt plate may rise to a higher temperature, e.g., approximately 150° C. or greater, than the desired temperature of a melt duty cycle.

Ink sticks not engaging the melt plate during a melt cycle which may result from an ink out condition in which a feed channel has exhausted its available supply of solid ink sticks and an ink stick jam condition in which one or more ink sticks get trapped or jammed in an ink feed channel prior to reaching the melt plate at the end of the channel. Ink stick jams may occur due to ink sticks becoming skewed in the respective feed channel as they are being fed toward the melt plate. Ink stick jams may also occur due to ink stick particles and debris accumulating on to the bottom surface of a channel.

Possible ink out conditions and ink jam conditions in a feed channel may be detected by monitoring one or more characteristics of the melt duty cycle. Melt duty cycle characteristics that may be monitored to detect possible ink out or ink jam conditions include melt plate temperature during a melt duty cycle, magnitude of a melt plate temperature change over a span of time, and rate of melt plate temperature change over a span of time. For example, a possible ink out or jam condition may be detected by monitoring the temperature of the melt plates using the melt plate sensors, e.g., thermistors, and comparing the melt plate temperatures to a predetermined value indicative of non-engagement between a melt plate heater and ink stick. The variation from the melt temperature or power level that may be indicative of an ink out or ink jam condition may be any suitable temperature or power level. In one embodiment, in which the melt temperature of solid ink is approximately 100° C. to 140° C., the temperature selected to indicate an ink out or ink jam condition may be approximately 150° C. and greater.

Possible ink out or ink jam conditions may be detected by monitoring the power level supplied to the melt plate during a melt duty cycle, the magnitude of a change ink power level supplied to the melt plate over a span of time, and the rate of change of the power level supplied to the melt plate over a span of time. For example, in another implementation, a PTC or thermal governing function may be incorporated to prevent the melt plate and/or heater element from attaining an undesired or unsafe elevated temperature. The implementation may allow this heating system to reach that limit in normal operation. A faster rate of temperature increase may result from an ink stick jam so with the above or any other melt plate heating system, a jam condition may be determined when a temperature rise rate occurs more rapidly than would occur when the ink continues to feed into the melt plate. This method of feed impairment detection may be employed as an alternative or in addition to using an upper limit to signify a jam condition or be a consideration for determining an ink out condition. In a similar implementation, the case where a stick has been feeding and melting, a temperature change would not necessarily be present if the melt were operating at an upper governed temperature prior to a stick jam or out condition. In this case, the energy or power level required to maintain that temperature may be reduced significantly enough that monitoring the energy signal level would provide the requisite information to determine that a jam likely occurred.

The above listed melt duty cycle characteristics are related primarily to the melt plate, and, in particular, to the temperature of the melt plate, either directly (actual temperature) or indirectly (power level supplied to melt plate). Another characteristic of a melt duty cycle that may be monitored to detect possible ink out or ink jam conditions is the ink level in a receiving reservoir during a melt duty cycle. For example, if an ink level sensor in a receiving reservoir indicates that the ink level in the reservoir has not changed or has not been replenished to a certain level after a predetermined amount of time determined to be sufficient for ink replenishment, a possible ink out or ink jam condition may be indicated.

Typically, once a characteristic of a melt duty cycle indicates that an ink out or ink jam condition may be occurring in a feed channel, the controller interrupts the application of power to the melt plate, printing is disabled, and a user intervention fault is declared. For example, a user intervention fault may include alerting the printing operator to the ink out or ink jam condition and the operator is prompted to take corrective action such as inserting ink sticks in the feed channel having an ink out condition or attempting manual removal of jammed ink sticks from a feed channel having an ink jam condition.

As an alternative to declaring a user intervention fault when an ink out condition or ink jam condition, the present disclosure is directed to a system and method that enables ink out and ink jam conditions to be distinguished and proposes an automatic jam recovery routine that may be performed as an alternative to or prior to declaring a user intervention fault. The ink stick jam recovery routine uses sensors in the feed channels to detect the presence, or absence, of ink sticks at multiple positions along a feed channel and, in particular, to check for jammed ink sticks. The use of multiple sensors in a feed channel enables ink out conditions to be distinguished from ink jam conditions. For example, if a melt duty cycle characteristic indicates that an ink stick may not be in engagement with the melt plate when a melt duty cycle is initiated but the feed channel sensors indicate the presence of an ink stick at one or more positions along the feed channel, a possible ink jam condition may be indicated. If jammed ink sticks are detected, then the drive member that transports ink sticks in the feed channel having the ink jam condition may go through a series of back and forth movements in an attempt to free the jammed ink stick. If the ink stick does not free after several attempts, then a user intervention fault may be declared.

Figure 6:
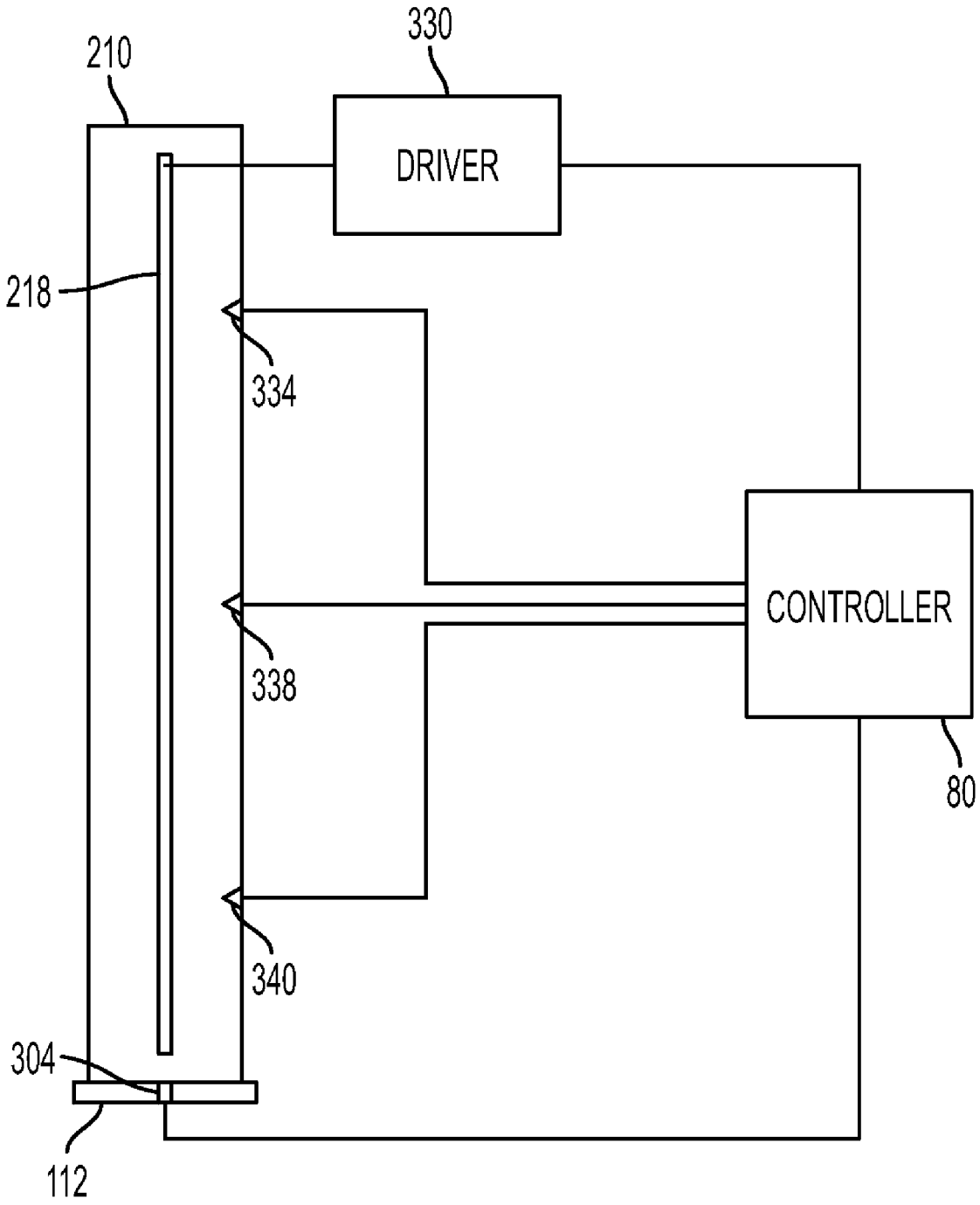
FIG. 6 is a schematic diagram of an ink jam detection and recovery system.

FIG. 6 shows a schematic diagram of an embodiment of an ink jam detection and recovery system. The ink jam detection and recovery system of FIG. 6 is depicted in conjunction with a single feed channel to simplify the discussion. Similar systems, of course, may be implemented in each feed channel of the imaging device. As depicted in FIG. 6, the ink jam detection and recovery system includes a plurality of sensors 334, 338, 340 and a controller 80 in communication with the plurality of sensors, the melt plate temperature sensor 304, and the ink transport driver 330 for the feed channel.

The plurality of sensors, referred to herein as ink stick detectors, are configured to detect or sense the presence or absence of the ink sticks at one or more positions along a feed path of a feed channel or chute 210. In the embodiment of FIG. 4, three ink stick detectors are utilized that are each positioned at a predetermined location along the feed channel 210. For example, the ink stick detectors include an insertion end detector 334 for detecting the presence or absence of ink at or near the insertion end of the feed channel, a mid-point detector 338 for detecting the presence or absence of ink at or near a mid-point of the feed channel, and a melt end detector 340 for detecting the presence or absence of ink at or near the melt end of the channel. More or fewer ink stick detectors, however, may be used. For example, ink stick detectors may arrayed at predetermined intervals along the entire feed channel. The ink stick detectors may have any suitable configuration that permits reliable detection or sensing of the presence or absence of ink sticks in the channel. For example, the detectors may comprise mechanically settable flags, optical sensors, or any suitable type of sensor as are known in the art. A continuously variable sensor output value based on the ink column length or the position of an urging device may also be utilized. In addition, ink sticks may include features for interacting with the ink stick detectors to facilitate detection of ink. Sensor features may have any suitable configuration that permits reliable sensor actuation of a sensor or detector, directly or indirectly, such as by moving a flag or using an optical sensing system. For example, sensor features may comprise protrusions or indentations on the exterior surface of an ink stick. Some sensor features may have surfaces configured to reflect light from an optical source onto an optical detector.

The ink stick detectors 334, 338, 340 are configured to generate signals in response to detecting the presence of the end of the column of ink sticks or in response to detecting the absence of ink as an ink stick or column of ink passes by the detector that are output to the controller 80. The controller 80 may utilize the ink detection signals in a number of ways to ensure reliable operation of the printer 10. For example, if the detectors indicate that the column of ink in the feed channel has passed a certain point, e.g., past the mid-point or melt end detector, the controller may generate a user recognizable alert indicating a low ink condition in a feed channel. In addition, the ink stick detectors may be utilized by the controller in determining whether an ink stick jam condition has occurred.

As mentioned, the controller is in communication with the sensors 304 of the melt plates and is configured to receive the signals from the melt plate sensors indicative of, for example, the melt plate temperatures during a melt duty cycle. The controller 80 is configured to compare the melt plate temperatures indicated by the melt plate temperature sensors 304 to an operational temperature or temperature range assigned to correspond to the melt plate. The operational temperature or temperature range may be any suitable temperature or temperature range. For example, in one embodiment the melt plate operational temperature may be any value or range between approximately 100° C. and 140° C.

Figure 7:
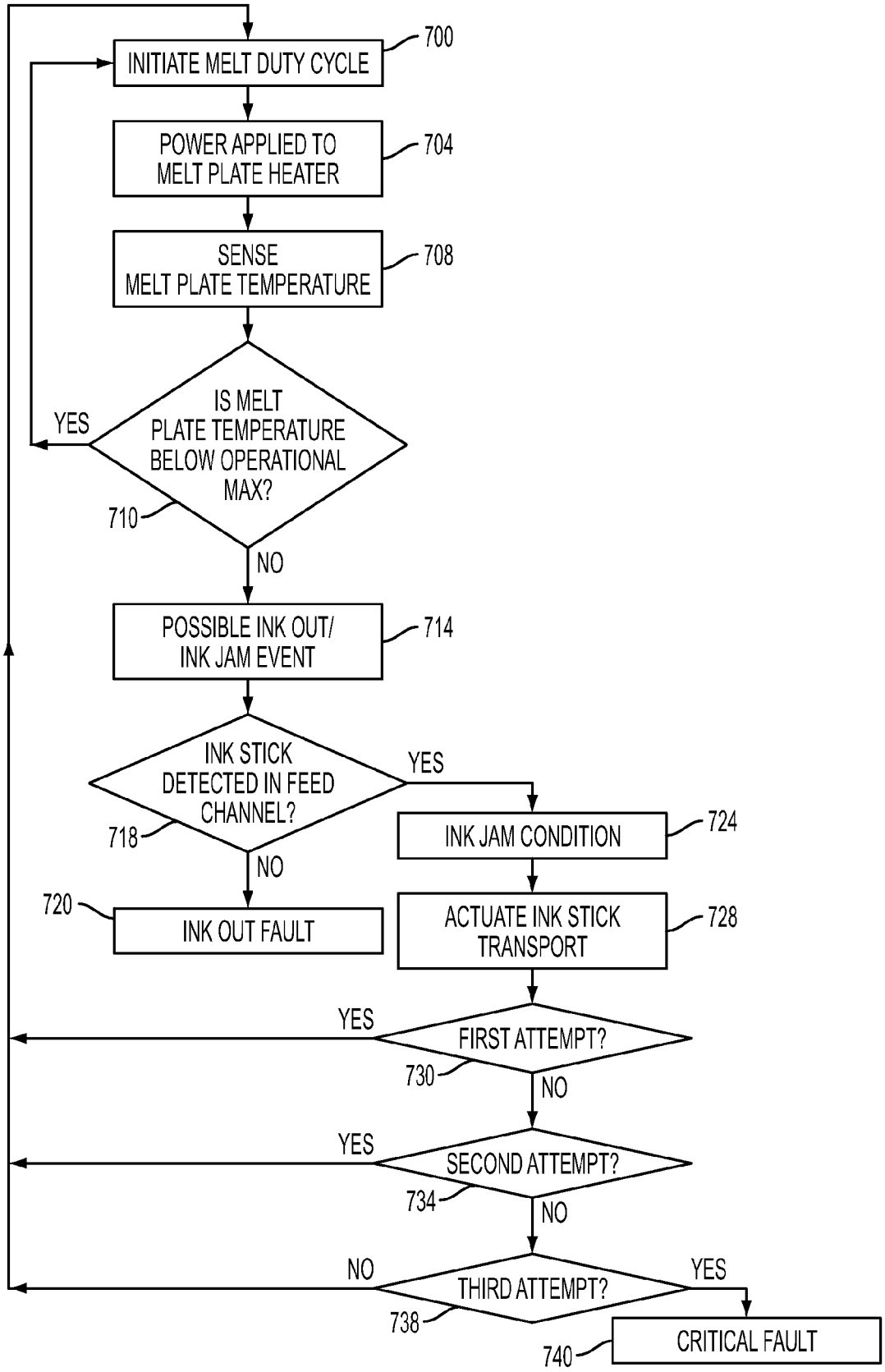
FIG. 7 is a flow chart of a method of ink jam detection and recovery that may be implemented by the system of FIG. 6.

FIG. 7 depicts a flow chart of one embodiment of an ink jam detection and recovery method. As mentioned, when a melt duty cycle is initiated (block 700), power is applied to the heating elements of a melt plate (block 704) to melt solid ink in engagement with the melt plate to liquid form. One or more sensors are configured to generate signals indicative of at least one characteristic of the melt duty cycle such as the melt plate temperature, melt plate power level, and receiving reservoir ink level. The signal(s) generated by the one or more sensors are output to the controller (block 708). The controller is then configured to process the sensor signals to determine if the characteristic of the melt duty cycle indicated by the sensor signals indicates that a possible ink out or ink jam condition exists. For example, the controller may be configured to recognize a possible ink jam/ink out condition if the detected temperature (or power level) of a melt plate during a melt duty cycle, exceeds the operational temperature or temperature range (block 710). If a possible ink jam/ink out condition is detected (block 714), the controller may disable or lower power to the melt plate in order to allow the melt plate to cool down to a temperature that is at or below the melt plate operational temperature or temperature range.

In order to distinguish between an ink jam condition and an ink out condition, the controller is configured to poll the ink detectors in the feed channel to determine whether ink sticks are present in the feed channel (block 718). If the signals generated by the ink detectors indicate that there are no ink sticks present in feed channel, a user intervention fault, which in this case is an ink out fault, may be declared (block 720). If an ink out fault is declared, the controller may disable print operations and generate a user recognizable alert, for example, by displaying a message on the user interface indicating that a feed channel is out of ink.

If the ink stick detectors indicate that an ink stick is present in the feed channel at one or more of the locations associated with the detectors, the controller is configured to recognize an ink jam condition (block 724). When an ink jam condition is detected, the controller is configured to implement a recovery routine that includes actuating the ink transport driver to cause the ink transport to move forward and/or backwards or both for a predetermined amount of time in an attempt to free jammed ink sticks and to bring ink sticks in the feed channel into engagement with the melt plate (block 728). In one particular embodiment, the ink transport driver may be actuated to run the transport belt in reverse for approximately 5 seconds and then forward for approximately 10 s. Any combination and duration of forward and/or backward movement of the ink stick transport belt may be utilized to attempt to free jammed ink sticks in a feed channel.

Once an attempt has been made to free jammed ink sticks in a feed channel, a melt duty cycle may again be initiated by the controller (block 700) and the process may then be repeated. The ink jam recovery process may be repeated any suitable number of times. For example, the controller may be configured to count the number of iterations of the recovery routine (blocks 730, 734, 735). If repeated attempts at freeing jammed ink sticks are not successful, the controller may be configured to recognize a critical fault condition and disable print operations and alert a user that a fault has occurred and that a service call may be required.

Although not depicted in FIG. 7, the controller may also be configured to compare the detected melt plate temperatures to a predetermined critical fault temperature or temperature range. Detected melt plate temperatures that fall below a minimum or exceed a maximum critical fault temperature may be indicative of a defective melt plate assembly that may require a service call and/or replacement of a defective part. The critical fault temperatures may be any temperature or temperature range. In one embodiment, a critical fault may be indicated by a melt plate temperature that exceeds the operational temperature or temperature range by about 30° C. If the controller determines that the melt plate temperature indicates a critical fault condition, the controller may be configured to disable the melt plate, disable print operations, and alert a user that a critical fault has occurred and that a service call may be required.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An ink jam detection and recovery system for use in a phase change ink imaging device comprising:

an ink stick conveyance configured to move ink sticks in a forward direction toward a melt plate at a melt end of an ink stick feed path and a reverse direction away from the melt plate toward an insertion end of the ink stick feed path;

a sensor system configured to generate a first signal indicative of a characteristic of at least one of the melt plate and a receiving reservoir configured to receive melted ink from the melt plate, the characteristic being at least one of a melt plate temperature change over a span of time, a melt plate power level change over a span of time, a rate of change of power applied to the melt plate, a rate of temperature change of the melt plate, and a rate of change of a receiving reservoir volume sensor that indicates whether an ink stick is present at the melt plate;

an ink stick detecting system having a plurality of ink stick sensors, each ink stick sensor being positioned at a different location proximate the ink stick feed path, the ink stick detecting system being configured to generate a second signal indicative of whether an ink stick is on the ink stick feed path between the melt end and the insertion end; and a controller operatively connected to the ink stick conveyance and the ink stick detecting system to receive the first signal and the second signal, the controller being configured to actuate the ink stick conveyance to move in at least one of the forward direction and the reverse direction in response to the characteristic indicating that no ink stick is present at the melt plate and the second signal indicating that an ink stick is on the ink stick feed path and to generate an ink out alert in response to the first signal indicating no ink stick is present at the melt plate and the second signal indicating that no ink sticks are on the ink stick feed path.

2. The system of claim 1, the ink stick conveyance comprising a belt, a drive pulley for turning the belt, and a bi-directional motor assembly for turning the drive pulley in the forward direction and the reverse direction.

3. The system of claim 2, the controller being configured to actuate the ink stick conveyance to move in the reverse direction for a first duration then to move in the forward direction for a second duration in response to the first signal indicating that no ink stick is present at the melt plate and the second signal indicating that an ink stick is on the ink stick feed path.

4. The system of claim 3, the first duration being approximately 5s, and the second duration being approximately 10s.

5. A method of ink stick jam detection and recovery for use in a phase change ink imaging device, the method comprising:

generating a first signal indicative of a characteristic of at least one of a melt plate and a receiving reservoir configured to receive melted ink from the melt plate, the characteristic being at least one of a melt plate temperature change over a span of time, a melt plate power level change over a span of time, a rate of change of power applied to the melt plate, a rate of temperature change of the melt plate, and a rate of change of a receiving reservoir volume sensor that indicates whether an ink stick is present at the melt plate;

generating a second signal indicative of whether one or more ink sticks are on an ink stick feed path between the melt end of the ink stick feed path and an insertion end of the ink stick feed path;

actuating an ink stick conveyance to move in at least one of a forward direction toward the melt end and a reverse direction away from the melt end in response to the first signal indicating that no ink stick is present at the melt plate and the second signal indicating that an ink stick is present on the ink stick feed path; and generating an ink out alert in response to the first signal indicating that no ink stick is present at the melt plate and the second signal indicating that no ink sticks are on the ink stick feed path.

6. The method of claim 5, the actuation of the ink stick conveyance further comprising:

actuating the ink stick conveyance to move in the reverse direction for a first duration and then to move in the forward direction for a second duration in response to the first signal indicating that no ink stick is present at the melt plate and the second signal indicating that an ink stick is present on the feed path.

7. A method of ink stick jam detection and recovery for use in a phase change ink imaging device, the method comprising:

measuring a temperature of a melt plate during a melt duty cycle, the melt plate being positioned at a melt end of an ink stick feed path of an ink loader of a phase change ink imaging device;

comparing the temperature to a predetermined temperature;

detecting whether ink sticks are on the ink stick feed path in response to the comparison indicating that the melt plate temperature exceeds the predetermined temperature; and actuating an ink stick conveyance to move in at least one of a first direction toward the melt end for a first duration and a second direction away from the melt end for a second duration in response to the detection indicating that an ink stick is present on the ink stick feed path.

8. The method of claim 7, further comprising:

generating an ink out alert in response to the melt plate temperature being greater than the predetermined temperature and the detection indicating that no ink sticks are present on the feed path.

9. The method of claim 8, the predetermined temperature being greater than 140° C.

10. The method of claim 9, the actuation of the ink stick conveyance further comprising:

actuating the ink stick conveyance to move in the second direction then the first direction in response to the comparison indicating that the temperature is greater than the predetermined temperature and the ink stick detection indicating that an ink stick is present on the feed path.

11. The method of claim 10, the ink stick conveyance comprising a belt, a drive pulley for turning the belt, and a bi-directional motor assembly for turning the drive pulley in the first direction and the second direction.

* * * * *